US011131944B2

(12) United States Patent
Saito et al.

(10) Patent No.: US 11,131,944 B2
(45) Date of Patent: Sep. 28, 2021

(54) DEVELOPING DEVICE REGULATES AN AMOUNT OF DEVELOPER ON A DEVELOPING SLEEVE

(71) Applicants: Kei Saito, Tokyo (JP); Kentarou Matsumoto, Tokyo (JP); Masaki Takahashi, Tokyo (JP); Takahiro Adachi, Kanagawa (JP)

(72) Inventors: Kei Saito, Tokyo (JP); Kentarou Matsumoto, Tokyo (JP); Masaki Takahashi, Tokyo (JP); Takahiro Adachi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/064,604

(22) Filed: Oct. 7, 2020

(65) Prior Publication Data

US 2021/0165344 A1 Jun. 3, 2021

(30) Foreign Application Priority Data

Nov. 29, 2019 (JP) ..... JP2019-216503

(51) Int. Cl.
*G03G 15/08* (2006.01)
*G03G 9/097* (2006.01)
*G03G 15/09* (2006.01)

(52) U.S. Cl.
CPC ..... *G03G 15/0877* (2013.01); *G03G 9/09708* (2013.01); *G03G 15/0812* (2013.01);
(Continued)

(58) Field of Classification Search
CPC ..... G03G 15/0877; G03G 15/09; G03G 15/0865; G03G 9/09708;
(Continued)

(56) References Cited

U.S. PATENT DOCUMENTS

2012/0093543 A1* 4/2012 Ikeda ..... G03G 9/0819 399/267
2014/0086641 A1* 3/2014 Ochi ..... G03G 15/0805 399/267
(Continued)

FOREIGN PATENT DOCUMENTS

JP 2007-121964 5/2007
JP 2012-177847 9/2012

*Primary Examiner* — Walter L Lindsay Jr.
*Assistant Examiner* — Laura Roth
(74) *Attorney, Agent, or Firm* — Xsensus LLP

(57) ABSTRACT

A developing device includes a developer container, a developing roller, and a doctor member. The developer container contains a developer including a toner and a developer. The developing roller includes a developing sleeve bearing the developer, a magnet roller in the developing sleeve. The doctor member includes a regulating portion regulating an amount of the developer home on the developing sleeve to be a predetermined amount. The regulating portion is disposed with a first distance from the developing sleeve. The developing sleeve is disposed with a second distance from an image hearer, and when the developing sleeve bearing the predetermined amount of developer passes a vicinity of the image bearer, a value obtained by dividing the predetermined amount by the second distance is less than a threshold of occurrence of adherence of the developer to the developing sleeve.

20 Claims, 7 Drawing Sheets

(52) U.S. Cl.
CPC ..... *G03G 15/0813* (2013.01); *G03G 15/0865* (2013.01); *G03G 15/09* (2013.01); *G03G 15/0928* (2013.01); *G03G 2215/0609* (2013.01)

(58) Field of Classification Search
CPC ..... G03G 2215/0609; G03G 15/0805; G03G 15/0812; G03G 15/0813; G03G 2215/0866; G03G 15/0928
See application file for complete search history.

(56) References Cited

U.S. PATENT DOCUMENTS

| | | | | |
|---|---|---|---|---|
| 2014/0356032 | A1* | 12/2014 | Abe | G03G 15/0921 399/277 |
| 2016/0238966 | A1 | 8/2016 | Oshikawa et al. | |
| 2017/0108795 | A1 | 4/2017 | Oshikawa et al. | |
| 2017/0261878 | A1* | 9/2017 | Nakamura | G03G 9/0827 |

* cited by examiner

| NO. | ρ/Gp | SLEEVE ADHERENCE LEVEL | REMARKS |
|---|---|---|---|
| 1 | 120 | GOOD | |
| 2 | 220 | FAIR | Gp : NARROW, ρ : LARGE |
| 3 | 220 | FAIR | Gp : WIDE, ρ : SMALL |
| 4 | 240 | BAD | |

DEVELOPING DEVICE REGULATES AN AMOUNT OF DEVELOPER ON A DEVELOPING SLEEVE

CROSS-REFERENCE TO RELATED APPLICATIONS

This patent application is based on and claims priority pursuant to 35 U.S.C. § 119(a) to Japanese Patent Application No. 2019-216503, filed on Nov. 29, 2019, in the Japan Patent Office, the entire disclosure of which is incorporated by reference herein.

BACKGROUND

Technical Field

Aspects of the present disclosure relate to a developing device, a process cartridge, and an image forming apparatus.

Related Art

Generally, there is known an electrophotographic image forming apparatus that includes a developing device of a two-component developing system. In such a developing device, a doctor member is disposed so that a projecting end surface maintains a predetermined doctor gap with respect to a developing roller, and the amount of developer supplied onto the developing roller is adjusted by the function of the doctor member.

SUMMARY

In an aspect of the present disclosure, there is provided a developing device that includes a developer container, a developing roller, and a doctor member. The developer container contains a developer including a toner and a developer. The developing roller includes a developing sleeve bearing the developer, a magnet roller in the developing sleeve. The doctor member includes a regulating portion regulating an amount of the developer home on the developing sleeve to be a predetermined amount. The regulating portion is disposed with a first distance from the developing sleeve. The developing sleeve is disposed with a second distance from an image bearer, and when the developing sleeve bearing the predetermined amount of developer passes a vicinity of the image bearer, a value obtained by dividing the predetermined amount by the second distance is less than a threshold of occurrence of adherence of the developer to the developing sleeve.

In another aspect of the present disclosure, there is provided a process cartridge that includes the developing device.

In still another aspect of the present disclosure, there is provided an image forming apparatus that includes the process cartridge.

In still yet another aspect of the present disclosure, there is provided an image forming apparatus that includes the developing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
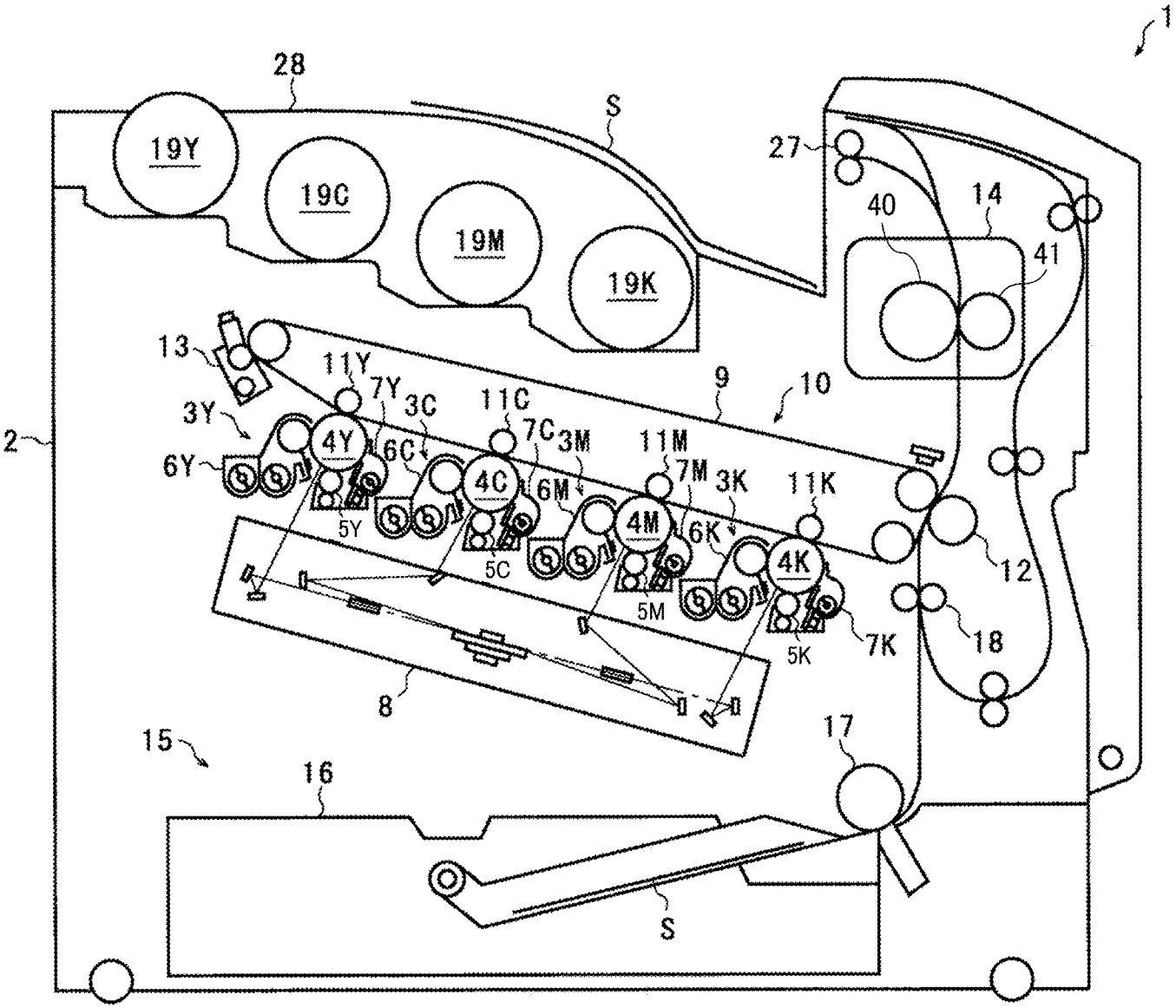
FIG. 1 is a schematic view of the configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 depicts a color copying machine as an image forming apparatus according to an embodiment of the present disclosure. Process cartridges 3Y, 3C, 3M, and 3K, to form color toner images of yellow (Y), cyan (C), magenta (M), and black (K), respectively, are arranged in the center of an apparatus body 2 of a color copying machine 1. The process cartridges 3Y, 3C, 3M, and 3K include corresponding photoconductive drums 4Y, 4C, 4M, and 4K, respectively, as image bearers. In FIG. 1, charging device 5Y, 5C, 5M, and 5K, developing devices 6Y, 6C, 6M, and 6K, and photoconductor cleaning device 7Y, 7C, 7M, and 7K are disposed around the photoconductive drums 4Y, 4C, 4M, and 4K, respectively, that rotate clockwise. An optical unit 8 that irradiates each photoconductive drum 4 with laser light is disposed below the process cartridges 3Y, 3C, 3M, and 3K.

Above the process cartridges 3Y, 3C, 3M, and 3K, there is disposed an intermediate transfer unit 10 including an intermediate transfer belt 9 to transfer toner images formed by the process cartridges 3. The intermediate transfer unit 10 has a plurality of rollers supporting the intermediate transfer belt 9. As any one of the rollers is driven to rotate, the intermediate transfer belt 9 is driven counterclockwise in FIG. 1. At the positions on the inner peripheral side of the intermediate transfer belt 9 and opposite the photoconductive drums 4Y, 4M, 4C, and 4K, primary transfer rollers 11Y, 11C, 11M, and 11K, are arranged to primarily transfer the toner images formed on the photoconductive drums 4Y, 4M, 4C, and 4K onto the intermediate transfer belt 9.

A secondary transfer roller 12 that secondarily transfers the toner images, which have been primarily transferred onto the intermediate transfer belt 9, onto a transfer sheet S is disposed downstream of the primary transfer roller 11K in a traveling direction of the intermediate transfer belt 9. Further, a belt cleaner 13 that removes residual toner remaining on the intermediate transfer belt 9 after image transfer is disposed on the upstream side of the primary transfer roller 11Y in the traveling direction of the intermediate transfer belt 9. Above the secondary transfer roller 12, a fixing device 14 includes a heating roller 40 and a pressure roller 41 to fix the toner image transferred on the transfer sheet S.

A sheet feeder 15 is disposed at the bottom of the apparatus body 2. The sheet feeder 15 includes a sheet feeding cassette 16, a feed roller 17, and a registration roller pair 18, and feeds a transfer sheet S stored in a sheet feeding cassette 16 toward the registration roller pair 18 by the feed roller 17. The registration roller pair 18 feeds the transfer sheet S toward a secondary transfer nip at which the secondary transfer roller 12 and the intermediate transfer belt 9 come into contact at a predetermined timing when the toner image formed on the intermediate transfer belt 9 matches a predetermined position of the transfer sheet S. Toner bottles 19Y 19C, 19M, and 19K containing toner of corresponding colors are disposed on an upper portion of the apparatus body 2 to supply to the respective developing device 6.

Figure 2A:
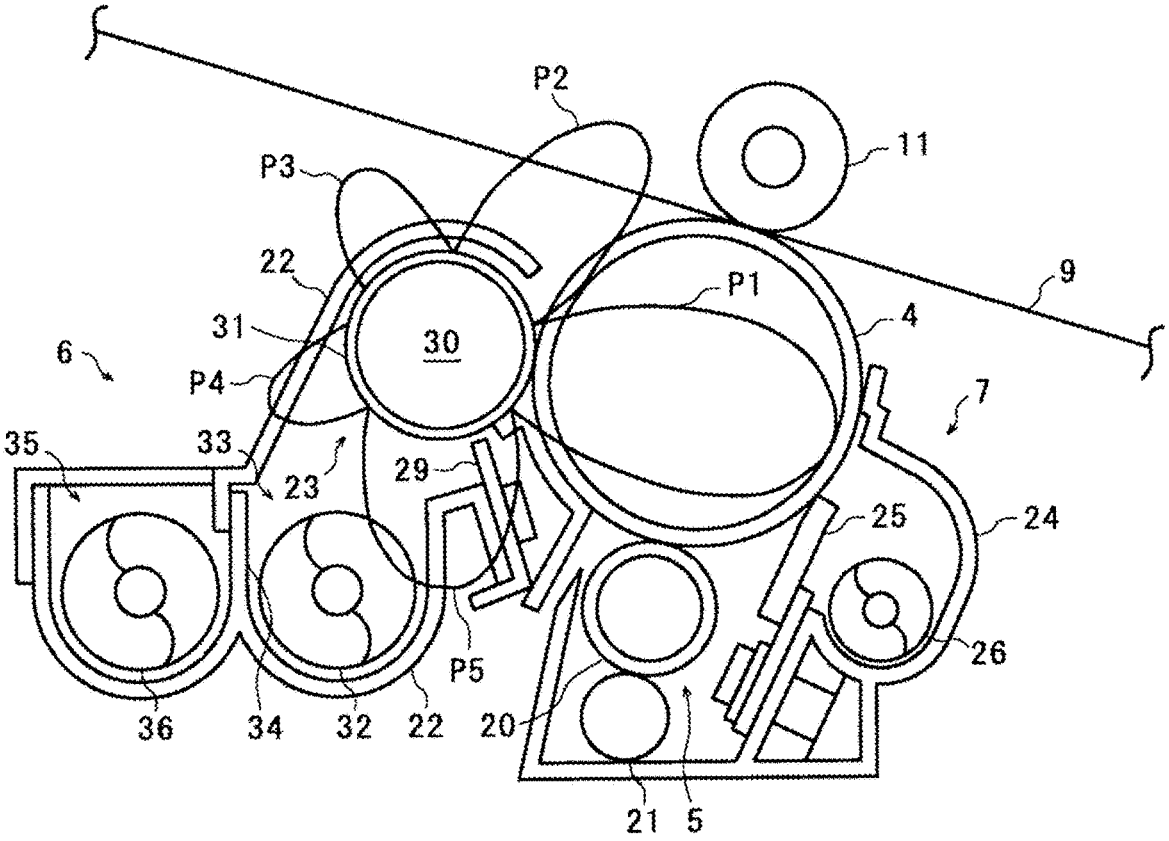
FIGS. 2A and 2B are schematic views of the configuration of a developing device according to an embodiment of the present disclosure.

Next, each process cartridge 3 is described. Each of the process cartridges 3 is similarly configured except for the colors of toner contained therein. As illustrated in FIG. 2A, in the process cartridge 3, a charging device 5, a developing device 6, and a photoconductor cleaning device 7 are sequentially disposed around the photoconductive drum 4 that rotates clockwise in FIG. 2A. The charging device 5 includes a charging roller 20 in contact with the peripheral surface of the photoconductive drum 4 and a charging cleaning roller 21 to clean the surface of the charging roller 20. The developing device 6 includes a developing roller 23 disposed opposite and adjacent to the surface of the photoconductive drum 4. The developing roller 23 is disposed in a developing case 22 serving as a developer container having an opening. The developing device 6 is described later. The photoconductor cleaning device 7 includes a cleaning case 24 having an opening, a cleaning blade 25 to clean the surface of the photoconductive drum 4, and a waste toner screw 26 to convey a waste toner removed from the surface of the photoconductive drum 4 to a waste toner bottle.

Here, an example of the operation of the process of obtaining a color image using the color copying machine 1 is briefly described. First, in each process cartridge 3, the photoconductive drum 4 is uniformly charged by the charging device 5. After that, an optical unit 8 is operated to expose and scan the surface of the photoconductive drum 4 with laser light, and an electrostatic latent image based on image data is formed on the surface of the photoconductive drum 4. The formed electrostatic latent image is developed with toner of the corresponding color by the operation of the developing device 6, and the toner image of the corresponding color is formed on the surface of the photoconductive drum 4. The toner image on the photoconductive drum 4 is superimposed and transferred onto the intermediate transfer belt 9 by the operation of the corresponding primary transfer roller 11. The photoconductive drum 4, which has the toner image transferred thereon, is cleaned by the photoconductor cleaning device 7 and prepares for the next image forming process.

On the other hand, in the sheet feeder 15, the transfer sheet S in the sheet feeding cassette 16 is separated and fed by the operation of the feed roller 17, and the transfer sheet S is fed to the secondary transfer nip at a predetermined timing by the operation of the registration roller pair 18. The transfer sheet S, on which a full color toner image formed on the intermediate transfer belt 9 at the secondary transfer nip, is conveyed to the fixing device 14 to fix the transferred image. After the transferred image is fixed on the transfer sheet S by the fixing device 14, the transfer sheet S is ejected onto an output tray 28 on the upper portion of the apparatus body 2 by an ejection roller pair 27. The ejection roller pair 27 is disposed on the downstream side of the fixing device 14 in a sheet conveyance direction. Similarly to the photoconductive drum 4, residual toner remaining on the intermediate transfer belt 9 is cleaned by the belt cleaner 13. Each color toner contained in each toner bottle 19 is replenished in a predetermined amount to the corresponding developing device 6 via a toner conveyance path, as needed.

Next, the developing device 6 is described. The developing device 6 is a developing device using two-component developer consisting of toner and carrier, and includes the developing roller 23 and a doctor blade 29 serving as a doctor member in the developing case 22. The developing roller 23 opposed to the photoconductive drum 4 includes a magnet roller 30 provided inside the developing roller 23 and a developing sleeve 31 provided around the magnet roller 30. The doctor blade 29 regulates the amount of developer borne on the developing sleeve 31.

Figure 2B:
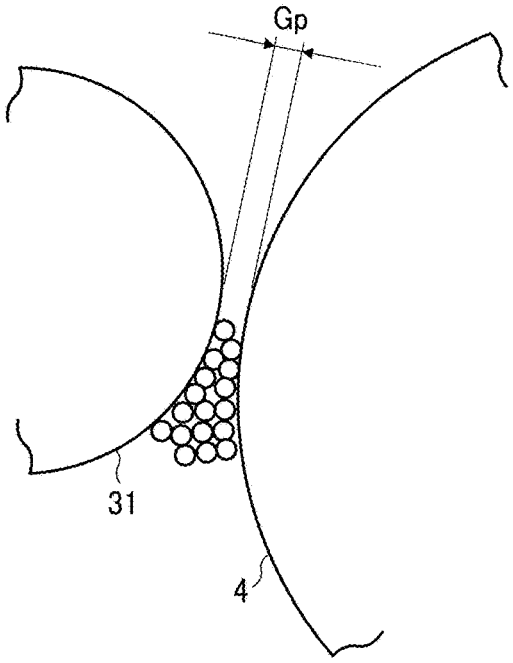

The developing sleeve 31, which has a cylindrical shape made of aluminum, is disposed at a position to maintain a predetermined developing gap Gp (illustrated in FIG. 2B), which is a second distance from the photoconductive drum 4. The developing sleeve 31 is driven by a driving member to rotate counterclockwise in FIG. 2A. The material of the developing sleeve 31 is not limited to aluminum and may be made of, for example, brass, stainless steel, a non-magnetic material such as conductive resin. The magnet roller 30 is provided in the developing sleeve 31 in a fixed state to form magnetic fields so that ears of the developer are generated on the developing sleeve 31. The carrier constituting the two-component developer forms ears on the developing sleeve 31 along the magnetic fields generated from the magnet roller 30. Further, a magnetic brush is formed when charged toner adheres to carrier constituting the ears.

The magnet roller 30 has a P1 pole (main pole) that is arranged so that the peak of the magnetic force is directed toward the center of the photoconductive drum 4. The magnet roller 30 also has P2, P3, P4, and P5 poles that are arranged in turn from the P1 pole in the rotational direction of the developing sleeve 31. A thin layer of the developer formed on the developing sleeve 31 by the P1 pole is formed in contact with the photoconductive drum 4, and the toner is provided for the developing process from the developer layer placed in a developing area opposite the photoconductive drum 4. Thereafter, as the developing sleeve 31 rotates, the developer is moved and returned into the developing case 22 by the magnetic force from the P2 pole along with the rotation of the developing sleeve 31, and then the developer is released from the developing sleeve 31 by the repulsive magnetic force of the P3 pole and the P4 pole and falls into the developing case 22.

In the developing case 22, a first stirring screw 32 is rotatably disposed so as to be parallel to the developing roller 23. The first stirring screw 32 rotates counterclockwise in FIG. 2A to constantly supply the developer to the developing sleeve 31. The first stirring screw 32 conveys, in the axial direction, the used developer released from the developing sleeve 31 in a first space 33 in the developing case 22 to stir and mix the used developer with unused developer in the first space 33. A second space 35 is formed in the developing case 22, which is separated by the first space 33 and an inner wall 34, to receive toner from a toner supply port, and a second stirring screw 36 is disposed in the second space 35. The second stirring screw 36 rotates counterclockwise in FIG. 2A to stir toner and carrier supplied from the toner supply port, and conveys the developer while imparting a predetermined charging potential to the toner. The inner wall 34 is disposed with a communication port communicating the first space 33 and the second space 35 with each other, and the developer is circulated through the first space 33 and the second space 35 through the communication port. Unused developer is borne and conveyed by the P5 pole and thinned on the developing sleeve 31 via the doctor blade 29, and the process described above is repeated.

Figure 3:
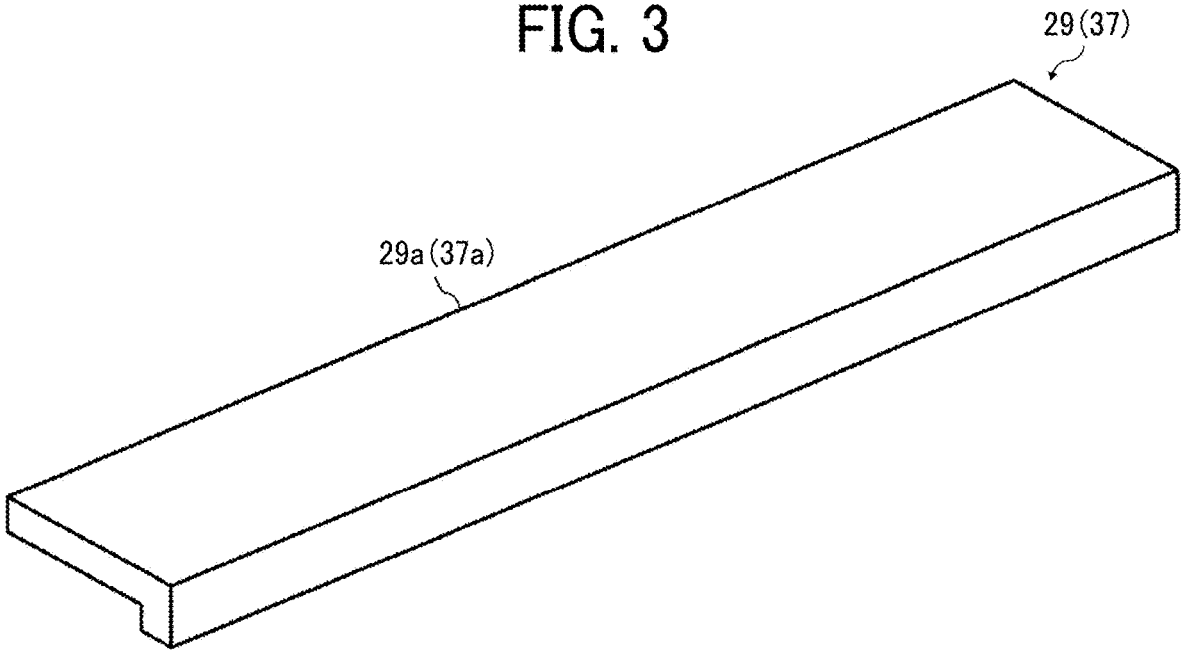
FIG. 3 is a schematic view of a doctor blade according to an embodiment of the present disclosure.

As illustrated in FIG. 3, the doctor blade 29 is a plate-shaped member made of metal and has an L-shaped cross section in which one end in the short direction is bent. The longitudinal ends of the doctor blade 29 is provided with mounting protrusions having holes for mounting to side plates of the developing case 22, and the doctor blade 29 is fixed to the side plates of the developing case 22 by screw members. An end portion of the doctor blade 29 opposite the bent side in the short direction is formed as a regulating portion 29*a* to regulate the amount of developer borne on the developing sleeve 31. The doctor blade 29 is positioned so that the regulating portion 29*a* can secure a predetermined doctor gap Gd (illustrated in FIG. 4), which is a first distance to the peripheral surface of the developing sleeve 31, when the ends of the doctor blade 29 are fixed to the side plates of the developing case 22. Here, the developing sleeve 31, which is rotatably supported by the developing case 22, is also positioned at a position at which a predetermined developing gap Gp (illustrated in FIG. 2B), which is the second distance from the photoconductive drum 4, is maintained.

Figure 4:
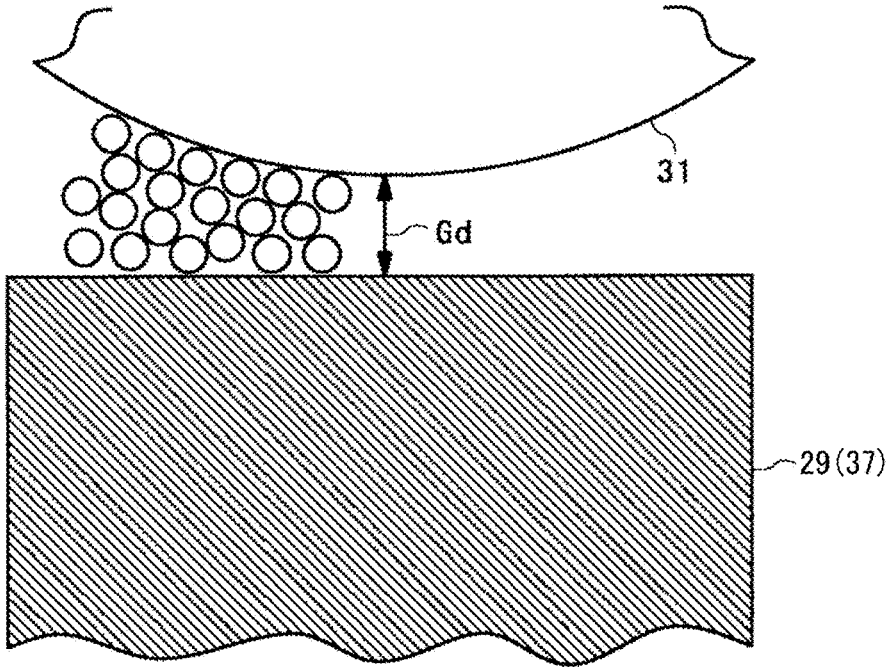
FIG. 4 is a schematic view of a doctor gap according to an embodiment of the present disclosure.

FIG. 4 depicts a state of developer when the developer passes between the doctor blade 29 and the developing sleeve 31. In FIG. 4, the sign Gd indicates a doctor gap, and a predetermined scooping amount ρ of developer changes depending on the size of the doctor gap Gd. As illustrated in FIG. 4, the gap between the doctor blade 29 and the developing sleeve 31 on the developer inlet side is wider than the doctor gap Gd. With such a configuration, in a tapered space in the range from the developer inlet to the doctor gap Gd, the force acting on the doctor blade 29 by the developer is greater in the longitudinal center of the doctor blade 29 than on the longitudinal left and right ends of the doctor blade 29. This is because the left and right ends of the doctor blade 29 are fixed to the developing case 22 and their movement is restricted, whereas movement of the center of the doctor blade 29 is not restricted and can be freely moved. Accordingly, the vicinity of the center of the regulating portion 29*a* is deformed so as to be wider than the left and right ends, and the doctor gap Gd changes so that the amount of developer passing in the center is greater than in the left and right ends. As a result, the amount of developer, which is borne by the developing sleeve 31 and is conveyed to the opposite part of the photoconductive drum 4, that is, the scooping amount ρ of developer becomes uneven in the longitudinal direction of the developing sleeve 31, thus causing uneven density.

Figure 5:
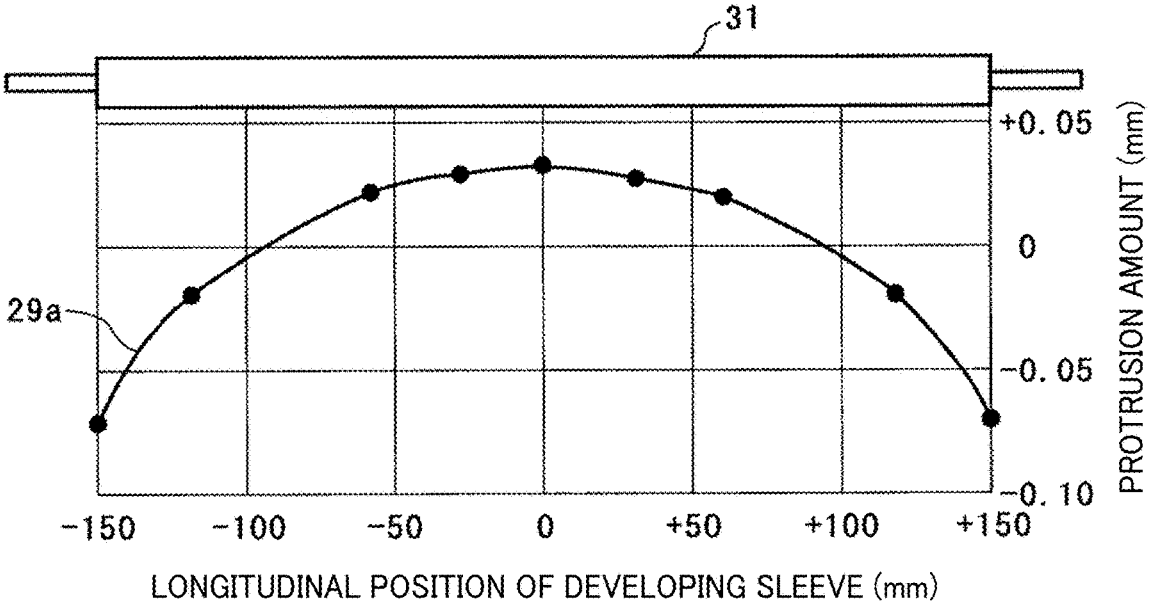
FIG. 5 is a schematic view illustrating the shape of a regulating portion of a doctor blade used to investigate an adherence threshold according to an embodiment of the present disclosure.

The technique disclosed in JP-2007-121964-A described above proposes a convex shape as the shape of the regulating portion 29*a* in order to prevent an increase in the scooping amount ρ at the center of the doctor blade 29, for example, the shape may be as illustrated in FIG. 5. Here, the axial length of the developing sleeve 31 is formed so as to be longer than an image forming area. Therefore, when adjusting the scooping amount ρ, it is necessary to adjust the scooping amount ρ within the image forming range to be a target value. Therefore, the scooping amount ρ of the regulating portion 29*a* is not adjusted in the entire area of the developing sleeve 31 in the longitudinal direction, and the inside of the image forming area is an adjustment area (in the example illustrated in FIG. 5, an inner area than each position of the convex amount of 0 in the longitudinal direction). In this case, since the doctor gap Gd is widened in a region outside the adjustment area, the scooping amount ρ becomes larger than in the adjustment area.

Further, since both ends of the developing sleeve 31 are fixed as compared with the center and the developing gap Gp does not fluctuate easily, a value obtained by dividing the scooping amount ρ by the developing gap Gp, i.e., ρ/Gp, that is, an adjustment amount of the scooping amount ρ is greater at both ends than at the center. In other words, since more developer passes through the developing gap Gp that remains narrow at both ends, both ends of the developing sleeve 31 are more likely to receive a large pressure from the developer. When a large pressure acts on the developer in this way, the toner using a charge adjusting material made of titanium oxide as developer does not cause any particular problem, but in the case of a toner having a high adhesion force such as a toner (i.e., titanium-less toner) in which titanium oxide is replaced by alumina, adherence of toner to the developing sleeve 31, that is, so-called developing sleeve adherence may be worsen, thus causing background stains. In order to prevent the occurrence of developing sleeve adherence, it is necessary to devise the shape of the regulating portion 29*a* so that the adjustment amount ρ/Gp is lower than the adherence threshold of the developing sleeve 31 at a point where the adjustment amount ρ/Gp tends to become large, especially at both ends of the developing sleeve 31 in the present embodiment. According to a first embodiment of the present disclosure, there is provided a doctor blade 29 capable of preventing the developing sleeve adherence.

In the first embodiment of the present disclosure, the inventors first investigated the effect of the adjustment amount ρ/GP on developing sleeve adherence by varying the scooping amount ρ and the development gap Gp, which affect the pressure acting on the developer in the developing area, in order to explore the characteristic values that effectively act on the developing sleeve adherence. A toner with high adhesion that was likely to cause developing sleeve adherence was used in the investigation, and the scooping amount ρ and the developing gap Gp were adjusted so that the adjustment amounts ρ/GP were 120, 220-1, 220-2, and 240. Here, the adjustment amount 220-1 was investigated when the developing gap Gp was narrowed and the scooping amount ρ was increased, and the adjustment amount 220-2 was investigated when the developing gap Gp was widened and the scooping amount ρ was decreased, respectively. The image formation was performed on 50,000 sheets in an actual machine, and the presence or absence of the developing sleeve adherence on the developing sleeve 31 and the presence or absence of the background stains on the formed image were checked. The results of the investigation are illustrated in FIG. 6.

Figures 6, 7:
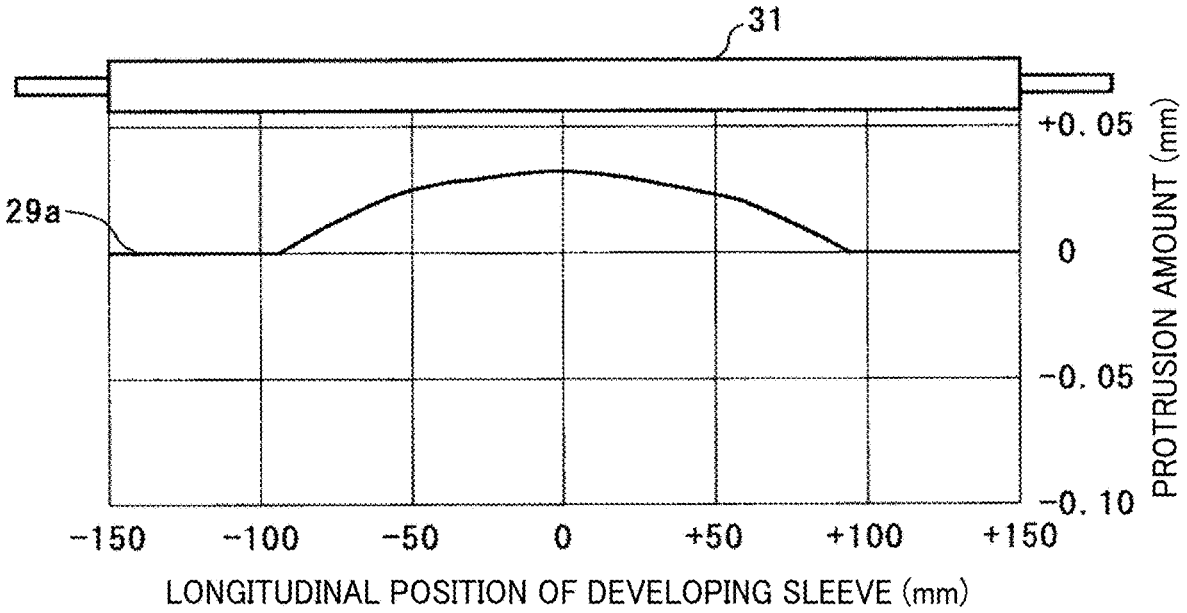
FIG. 6 is a table of a result of investigation of an adherence threshold according to an embodiment of the present disclosure.
FIG. 7 is a schematic view of the shape of a regulating portion of a doctor blade according to a first embodiment of the present disclosure.

According to the results of the investigation illustrated in FIG. 6, it can be seen that the larger the adjustment amount ρ/Gp, the worse the developing sleeve adherence. Further, according to the investigation results of Nos. 2 and 3, it was found that the contribution ratio of the scooping amount ρ and the developing gap Gp to the adjustment amount ρ/Gp was equivalent, and the same adjustment amount ρ/Gp was also equivalent to the level of the developing sleeve adherence. In this investigation, durable image formation was performed on up to 50,000 sheets for relative comparison. However, actual determination of the adherence threshold of the developing sleeve 31 is performed, for example, as follows. By varying the scooping amount ρ and the developing gap Gp at both ends of an image adjustment area, durable image formation is performed up to an amount corresponding to the product life of the developing device 6 under high temperature environmental conditions e.g., under the condition of ambient temperature 27° C.) to investigate whether the developing sleeve adherence occurs. At this time, the adherence threshold of the developing sleeve 31 is determined by measuring the scooping amount ρ and the developing gap Gp at the position where the developing sleeve adherence occurs.

According to the first embodiment of the disclosure, as described above, the doctor blade 29 including the regulating portion 29*a* is used in which the adjustment amount ρ/Gp is lower than the adherence threshold of the developing sleeve 31 determined by an investigation in an area where the developing gap Gp does not vary as the developer passes through. In other words, the shape of the regulating portion 29*a* is determined so that the adjustment amount ρ/Gp is lower than the adherence threshold of the developing sleeve 31. Thus, the occurrence of the developing sleeve adherence can be prevented even more than the conventional case and an output material with stable image quality with less background stains can be obtained.

FIG. 7 depicts an example of the doctor blade 29 (or the regulating portion 29*a*) with the shape of the regulating portion 29*a* determined so that the adjustment amount ρ/Gp is lower than the adherence threshold of the developing sleeve 31 according to the first embodiment. The doctor blade 29 (or the regulating portion 29*a*) illustrated in FIG. 7 has a convex shape in the vicinity of the center in the longitudinal direction as in the conventional case, but the shape of the doctor blade 29 at both ends of the longitudinal direction, where the developing sleeve adherence is more likely to occur, is formed to be almost parallel to the axial direction of the developing sleeve 31 without being more concave than the protrusion amount 0. Such a shape can prevent the increase of the scooping amount ρ in both ends while preventing the increase of the scooping amount ρ in the central portion, and a good image having less image unevenness can be provided.

Next, a second embodiment of the present disclosure is described. When a photoconductor with low rigidity, such as a belt-shaped photoconductor without a core metal, is used, the photoconductor is likely to be more deformed by the pressure of the developer. For example, even if the layer thickness of developer on the developing sleeve 31 is equalized, the developing gap Gp near the center of the longitudinal direction at the doctor blade 29 may be widened and the amount of toner adhered to the photoconductor may be reduced. In other words, in the vicinity of both ends fixed to the developing case 22, the developing gap Gp does not change and accordingly the image density is appropriately obtained. However, near the center that is easily deformed due to the low rigidity of the photoconductive drum 4, the image density may become low and uneven density may occur.

Figure 8:
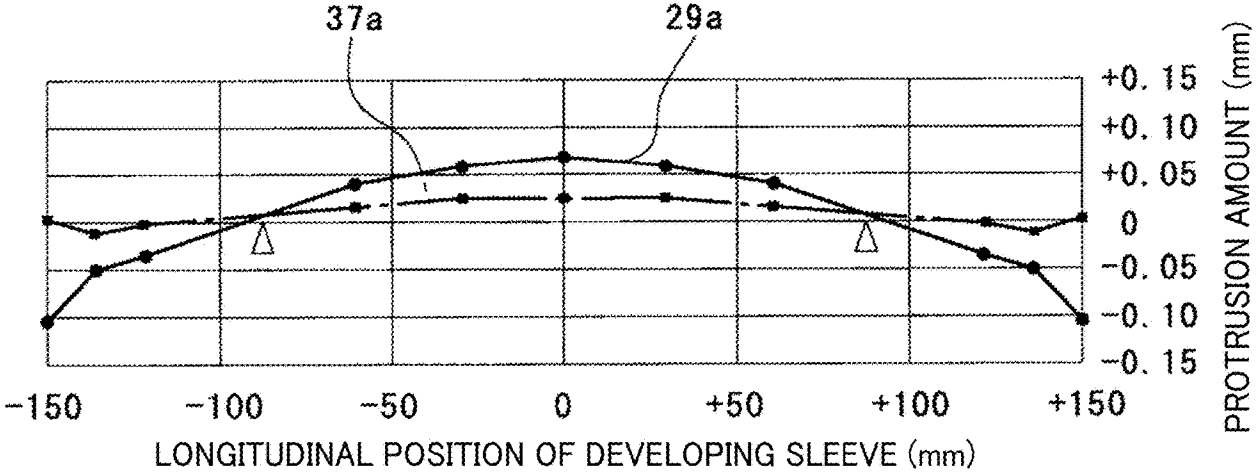
FIG. 8 is a schematic view of the shape of a regulating portion of a doctor blade according to a second embodiment of the present disclosure.

Hence, in the second embodiment, a doctor blade 37 is used as a doctor member including a linearly formed regulating portion 37*a*, as illustrated by the long-dashed and short-dashed line in FIG. 8. In the doctor blade 29 (or the regulating portion 29*a*) indicated by a solid line in FIG. 8, the spreading width of the doctor gap Gd at both ends is large. On the other hand, in the doctor blade 37, the regulating portion 37*a* is formed in a straight shape to restrict the protrusion amount in the central portion, and the scooping amount ρ in the central portion increased by the pressure of the developer is set to be larger than the scooping amount ρ in the doctor blade 29 and set the adjustment amount ρ/Gp in the central portion closer to the adjustment amount ρ/Gp in both ends, and the amount of developer adhered on the photoconductive drum 4 is made uniform in the longitudinal direction, and the occurrence of image unevenness is prevented. As described above, when the photoconductive drum 4 has low rigidity, the occurrence of image unevenness can be prevented by using the doctor blade 37 in which the regulating portion 37*a* is formed in a linear shape.

Figure 9:
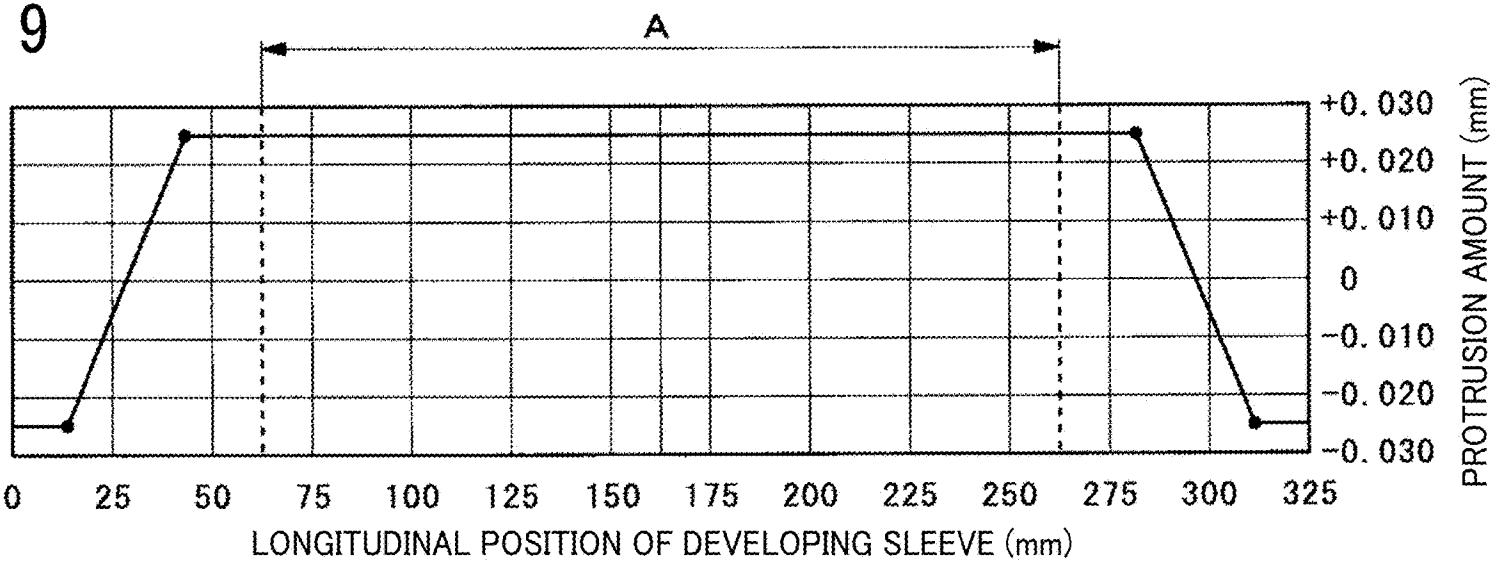
FIG. 9 is a schematic view of the straightness in the regulating portion of the doctor blade according to the second embodiment of the present disclosure.

In the second embodiment, the regulating portion 37*a* was formed in a linear shape, but when the straightness of the regulating portion 37*a* was changed to change the scooping amount ρ, it was found that it was effective in preventing image unevenness when the straightness was set to 0.05 (mm) or less. From this result, setting the straightness of the regulating portion 37*a* to 0.05 or less can prevent the occurrence of image unevenness. When a tolerance of the straightness of 0.05 is expressed in the drawing, the straightness of 0.05 is satisfied even if the regulating portion 37*a* has a shape as illustrated in FIG. 9. In the regulating portion having such a shape, when the scooping amount ρ is adjusted in the range A corresponding to the image adjustment area described above, the doctor gap Gd is widened by 0.05 mm on both ends with respect to the range A, and the scooping amount ρ in the ends may increase. For this reason, when determining the straightness, it is preferable to determine the straightness so that the adjustment amount ρ/Gp at both ends does not exceed the adherence threshold of the developing sleeve 31 even if the shape of the regulating portion is as illustrated in FIG. 9, and it is preferable that the adjustment amount ρ/Gp at both ends is as small as possible.

Figure 10A:
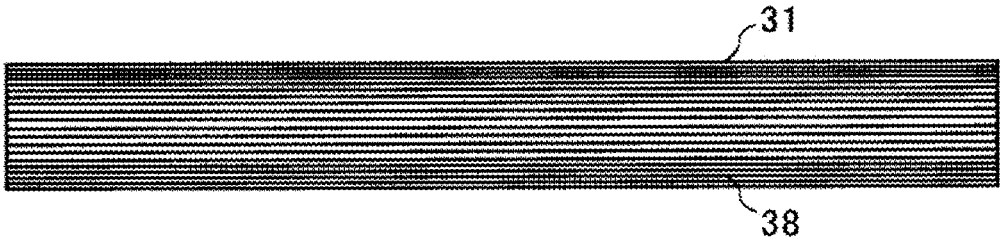
FIGS. 10A and 10B are schematic views of a developing sleeve according to a third embodiment of the present disclosure.
Figure 10B:
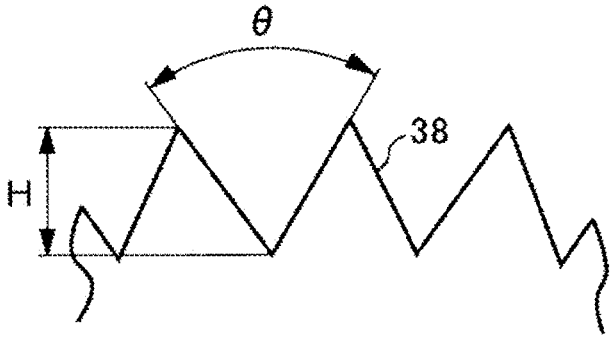

Next, a third embodiment of the present disclosure is described. If the straightness of the regulating portion 37*a* cannot be reduced due to the limit of processing and the adjustment amount ρ/Gp at the ends of the doctor blade cannot be reduced below the adherence threshold of the developing sleeve 31, a plurality of grooves 38 extending in the axial direction as illustrated in FIG. 10A may be formed on the outer peripheral surface of the developing sleeve 31 to reduce the adjustment amount ρ/Gp. Several shapes of moves 38 can be formed on the developing sleeve 31. For example, in this embodiment, a plurality of V-shaped grooves are arranged side by side in in the circumferential direction of the developing sleeve 31. The V-shaped grooves are less likely to decrease in the scooping amount ρ even if abrasion occurs over time as compared with the grooves of other shapes, and the developer can be supplied in a stable scooping amount ρ. As illustrated in FIG. 10B, the parameters determining the conveying force of the developer by the V-shaped grooves are the depth H and the angle θ, and the depth H is particularly effective. Since the scooping amount ρ varies with the depth H, the scooping amount ρ can be reduced and the developing sleeve adherence can be restrained by reducing the depth H only in the area where the developing sleeve adherence occurs.

Next, a fourth embodiment of the present disclosure will be described. As a method of reducing the scooping amount ρ, there is a method of changing a magnetic waveform of the developing roller 23. In the magnetic waveform of the magnet roller 30 illustrated in FIG. 2A, it has been found that the magnetic characteristics of the P4 pole and the P5 pole affect the scooping amount ρ. Therefore, the magnetic waveform is changed so as to reduce the magnetic flux densities of the P4 pole and the P5 pole only in the area where the developing sleeve adherence occurs, and the scooping amount ρ can be reduced and the developing sleeve adherence can be restrained.

In the above-described embodiments and modified examples, the example using the full-color copying machine 1 as an image forming apparatus is described. However, an image forming apparatus according to an embodiment of the present disclosure is not limited to such a full-color copying machine, and may be a printer, a facsimile, a multifunction peripheral, a monochrome machine, and the like. In the above-described embodiments, the configuration of using a transfer sheet S as a recording medium on which an image is formed is described. However, examples of the recording medium include thick paper, postcards, envelopes, plain paper, thick paper, coated paper (coated paper, art paper, etc.), tracing paper, overhead projector (OHP) sheet, OHP film, and resin film, and any material may be used as long as the material has a sheet shape and image formation and folding processing can be performed on the material.

Although several embodiments of the present disclosure have been described above, embodiments of the present disclosure are not limited to the above-described embodiments, and unless specifically limited in the description above, the above-described embodiments can be variously transformed and modified within the scope of the present disclosure as described in the claims. The effects described in the embodiments of the present disclosure are examples of the most suitable effects arising from the embodiments, the effects according to embodiments of the present disclosure are not limited to the above-described effects.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A developing device, comprising:

a developer container to contain a developer, the developer including a toner and a carrier;

a developing roller including:

a developing sleeve that bears the developer; and a magnet roller in the developing sleeve; and a regulating portion that regulates an amount of the developer on the developing sleeve to be a predetermined amount, wherein the regulating portion includes two end portions and a central portion between the two end portions, the two end portions are parallel to a central axis of the developing sleeve, the central portion has a convex shape such that a longitudinal center of the regulating portion is a first distance from the developing sleeve and the two end portions are a second distance from the developing sleeve, the first distance is smaller than the second distance, the developing sleeve is disposed a third distance from an image bearer, and an adjustment amount, which is equal to the predetermined amount divided by the third distance, is less than an adherence threshold of the developer to the developing sleeve.

2. The developing device according to claim 1, wherein the developer includes a charge control agent other than titanium oxide.

3. The developing device according to claim 2, wherein the developer includes a charge control agent including alumina.

4. The developing device according to claim 1, wherein the regulating portion has a straightness of 0.05 or less.

5. The developing device according to claim 1, wherein the developing sleeve has a plurality of grooves on a circumferential surface of the developing sleeve, and the plurality of grooves extends in an axial direction of the developing sleeve.

6. The developing device according to claim 5, wherein the grooves are V-shaped.

7. The developing device according to claim 6, wherein the predetermined amount is defined by a depth of the grooves.

8. An image forming apparatus, comprising the developing device according to claim 1.

9. A process cartridge, comprising:

an image bearer;

a developer container to contain a developer, the developer including a toner and a carrier;

a developing sleeve that bears the developer; and a regulating portion that regulates an amount of the developer borne on the developing sleeve to be a predetermined amount, wherein the regulating portion includes two end portions and a central portion between the two end portions, the two end portions are parallel to a central axis of the developing sleeve, the central portion has a convex shape such that a longitudinal center of the regulating portion is a first distance from the developing sleeve and the two end portions are a second distance from the developing sleeve, the first distance is smaller than the second distance, the developing sleeve is disposed a third distance from the image bearer, and an adjustment amount, which is equal to the predetermined amount divided by the third distance, is less than an adherence threshold of the developer to the developing sleeve.

10. An image forming apparatus, comprising the process cartridge according to claim 9.

11. The process cartridge according to claim 9, wherein the developing sleeve has a plurality of grooves on a circumferential surface of the developing sleeve, and the plurality of grooves extends in an axial direction of the developing sleeve.

12. The process cartridge according to claim 11, wherein the predetermined amount is defined by a depth of the grooves.

13. The process cartridge according to claim 9, further comprising:

a developing roller, wherein the developing roller includes the developing sleeve and a magnet roller that is in the developing sleeve.

14. A developing device, comprising:

a developer container to contain a developer;

a developing sleeve that bears the developer; and a regulating portion that regulates an amount of the developer on the developing sleeve, wherein the regulating portion includes two end portions and a central portion between the two end portions, the two end portions are parallel to a central axis of the developing sleeve, the central portion has a convex shape such that a longitudinal center of the regulating portion is a first distance from the developing sleeve and the two end portions are a second distance from the developing sleeve, the first distance is smaller than the second distance, the developing sleeve is disposed a third distance from an image bearer, and an adjustment amount, which is equal to the amount of developer on the developing sleeve divided by the third distance, is less than an adherence threshold of the developer to the developing sleeve.

15. The developing device according to claim 14, wherein the developer includes a charge control agent other than titanium oxide.

16. The developing device according to claim 15, wherein the developer includes a charge control agent including alumina.

17. The developing device according to claim 14, wherein the regulating portion has a straightness of 0.05 or less.

18. The developing device according to claim 14, wherein the developing sleeve has a plurality of grooves on a circumferential surface of the developing sleeve, and the plurality of grooves extends in an axial direction of the developing sleeve.

19. The developing device according to claim 18, wherein the grooves are V-shaped.

20. The developing device according to claim 19, wherein the regulating portion regulates the amount of the developer on the developing sleeve to be a predetermined amount that is defined by a depth of the grooves.

* * * * *